US010028568B2

(12) United States Patent
Lefevre et al.

(10) Patent No.: US 10,028,568 B2
(45) Date of Patent: Jul. 24, 2018

(54) DEVICE FOR PACKAGING A PRODUCT, IN PARTICULAR A COSMETIC PRODUCT

(71) Applicant: PARFUMS CHRISTIAN DIOR, Paris (FR)

(72) Inventors: Savine Lefevre, Compiegne (FR); Francois Gautier, Colombes (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 0 days.

(21) Appl. No.: 14/653,991

(22) PCT Filed: Dec. 16, 2013

(86) PCT No.: PCT/FR2013/053089

§ 371 (c)(1),
(2) Date: Jun. 19, 2015

(87) PCT Pub. No.: WO2014/096652

PCT Pub. Date: Jun. 26, 2014

(65) Prior Publication Data

US 2015/0342321 A1 Dec. 3, 2015

(30) Foreign Application Priority Data

Dec. 20, 2012 (FR) ..... 12 62415

(51) Int. Cl.
*A45D 40/02* (2006.01)
*A45D 40/10* (2006.01)
(Continued)

(52) U.S. Cl.
CPC ..... *A45D 40/10* (2013.01); *A45D 34/02* (2013.01); *A45D 40/02* (2013.01); *A45D 40/12* (2013.01); *A45D 40/264* (2013.01)

(58) Field of Classification Search
CPC ..... A45D 40/10; A45D 40/02; A45D 34/02; A45D 34/04; A45D 33/003; A45D 40/264;
(Continued)

(56) References Cited

U.S. PATENT DOCUMENTS 1,825,895 A * 10/1931 Younghusband ..... A45D 40/02 401/116
3,162,304 A * 12/1964 Bau ..... A45D 40/02 401/61
(Continued)

FOREIGN PATENT DOCUMENTS

GB 122565 1/1919
WO 9709901 3/1997

OTHER PUBLICATIONS

International Search Report, dated Jul. 27, 2014; PCT/FR2013/053089.

*Primary Examiner* — Jennifer C Chiang
(74) *Attorney, Agent, or Firm* — Hamre, Schumann, Mueller & Larson, P.C.

(57) ABSTRACT

The device comprises: a casing (10) having an open end (10'); a composition support (12), that is movable in the casing between a retracted position and an extended position; and an actuator (16) that is suitable for being moved so as to cause the support to move. The device further comprises first and second magnetic elements (20, 22) that are secured to the support and to the casing respectively. When the support is in its retracted position, the magnetic elements generate magnetic forces between them, which magnetic forces are suitable for holding said support in its retracted position. When the actuator is moved, it causes the support to move, moving the magnetic elements apart from each other, thereby reducing the magnetic forces in such a manner
(Continued)

as to enable the support to move towards its extended position.

16 Claims, 8 Drawing Sheets

(51) Int. Cl.
*A45D 40/12* (2006.01)
*A45D 34/02* (2006.01)
*A45D 40/26* (2006.01)

(58) Field of Classification Search
CPC ..... A45D 42/02; A45D 33/00; A45D 40/12; A61M 35/00; B43K 24/02; B43K 24/04; B43K 24/06
USPC ..... 401/55, 100
See application file for complete search history.

(56) References Cited

U.S. PATENT DOCUMENTS 4,238,163 A * 12/1980 Hung ..... B43K 21/003 401/100
6,588,958 B1 * 7/2003 Seidler ..... A45D 34/043 401/100
6,890,115 B2 * 5/2005 Le Moing, II ..... A45D 40/02 132/293
8,066,443 B2 * 11/2011 Thiebaut ..... A45D 40/02 401/82
8,821,057 B2 * 9/2014 Lambert ..... A45D 40/18 206/385
9,839,277 B2 * 12/2017 Lefevre ..... A45D 34/043
2004/0213624 A1 * 10/2004 Petit ..... A45D 40/02 401/100
2007/0025802 A1 * 2/2007 Dieudonat ..... A45D 40/02 401/100
2009/0175672 A1 7/2009 Killion et al.
2011/0020049 A1 * 1/2011 Liu ..... B43K 8/00 401/100
2011/0033219 A1 * 2/2011 Da Rovare ..... A45C 11/008 401/55
2011/0315161 A1 * 12/2011 Lim ..... A45D 40/264 132/301
2012/0027499 A1 * 2/2012 Hermouet ..... A45C 11/008 401/55
2012/0057920 A1 * 3/2012 Rolion ..... B43K 24/02 401/100
2016/0183661 A1 6/2016 LeFevre et al.

* cited by examiner

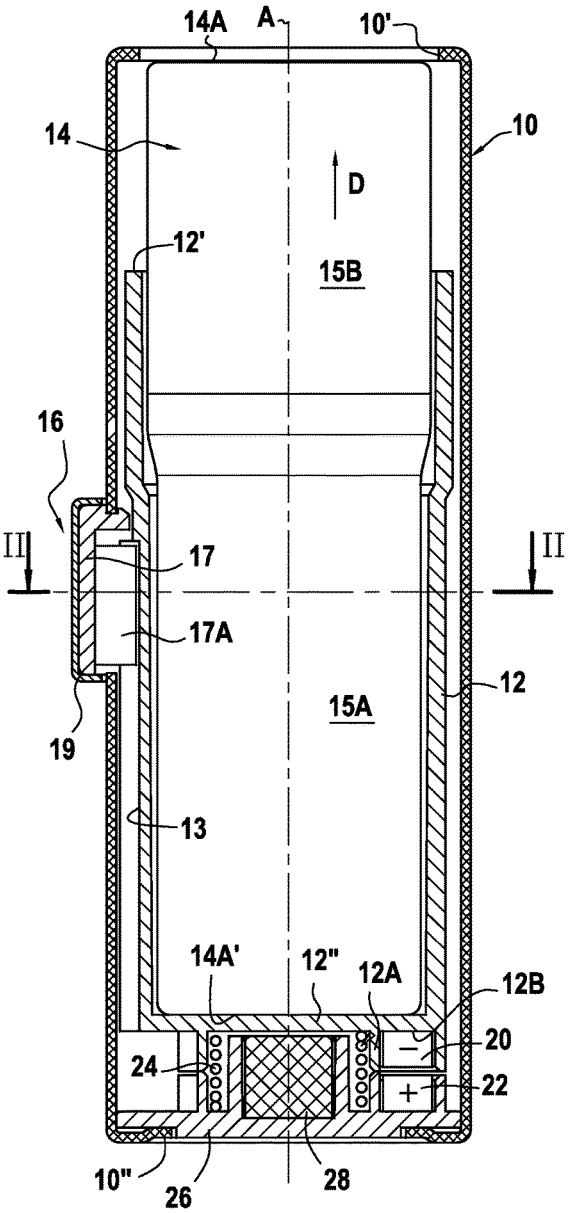
FIG.1
FIG.2A
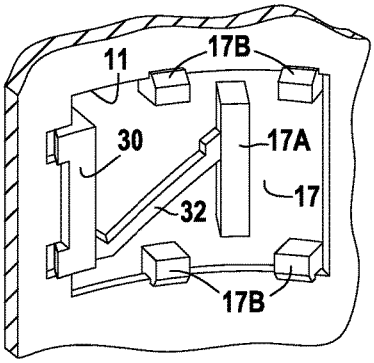
FIG.2
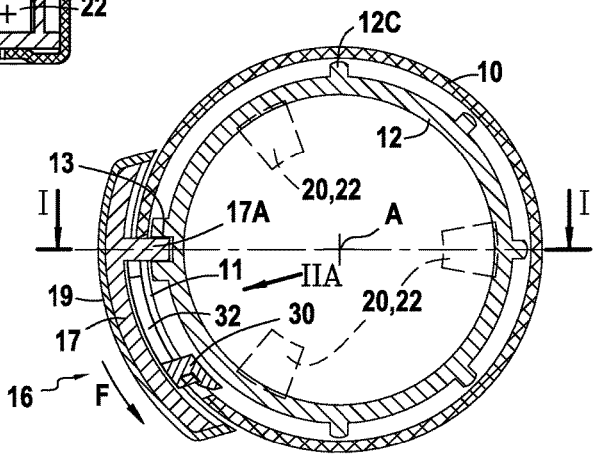

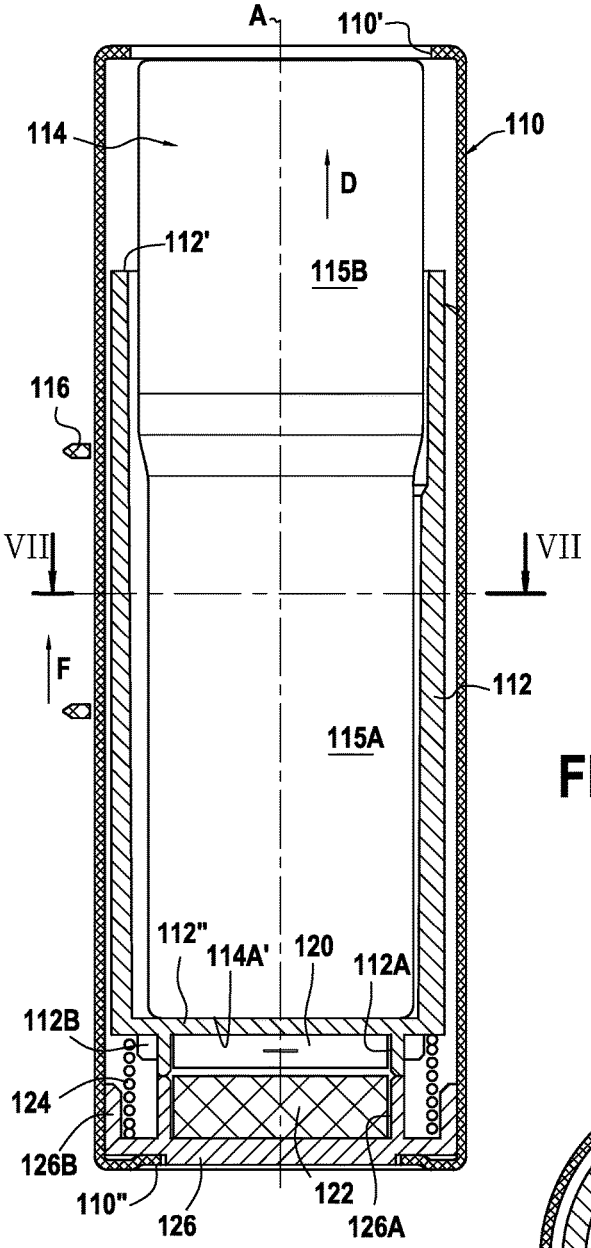
FIG.6
FIG.7
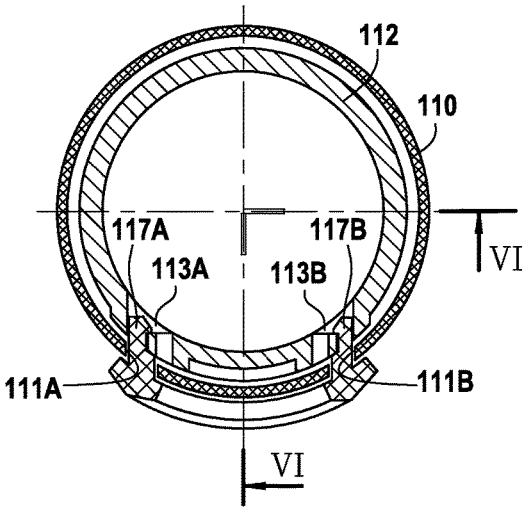

DEVICE FOR PACKAGING A PRODUCT, IN PARTICULAR A COSMETIC PRODUCT

The present invention provides a packaging device for packaging a composition, in particular a cosmetic composition, the device comprising: a casing having an open end; a composition support that is movable in the casing between a retracted position and an extended position that provides access to the composition via said open end; and an actuator that is suitable for being moved so as to cause the support to move from its retracted position to its extended position.

Devices of this type are known, in particular for cosmetic compositions of the lipstick, cream, and spray, e.g. mini-spray, type. This type of composition should be easy to carry, e.g. in a bag or a handbag, and should be easy to use frequently. Thus the packaging device should be light and compact, and the composition that it contains should be easy to extract, i.e. requiring little effort and being simple to do, without the user having to pay any particular attention when handling it. It should also be possible to return the device into its retracted position by means of a simple action, likewise not requiring any particular attention on the part of the user. In addition, the device must return to its retracted position and stay in this position in reliable manner, i.e. the support must not pass accidentally into its extended position.

Devices of this type are known in which the support is retained in its retracted position inside the casing by clipping or snap-fastening. Thus, in order to cause the support to pass into its extended position, the control piece must be actuated so as to cause one or more resilient clip or snap-fastener parts to flex until they escape from the complementary parts that hold them. Conversely, in order to return the composition into its retracted position, the support must be put back into place until it engages once again with the clip or snap-fastener means.

This type of device is advantageous in that it can be compact. However, the actions required are relatively complex, or, at the least, they may require a relatively large force for disengaging the clip or snap-fastener means. Conversely, if the means are adjusted so that the force required is small, there exists a risk of the means becoming disengaged unintentionally, and thus causing the composition contained in the device to become separated unintentionally from its casing. In addition, after frequent handling, the risk of wear, in particular associated with the friction involved while engaging and disengaging the clip or snap-fastener means, ends up being detrimental to the reliability of the device.

US 2011/315161 discloses a system for storing an article, which system, in one variant, presents a slidable support, a casing, and an actuator, and in which first and second magnetic elements are secured to a portion of the support and of the actuator respectively. The actuator may be turned between two positions, in which the magnetic elements attract or repel each other respectively. The system is relatively complex and does not enable the article to be extracted easily.

U.S. Pat. No. 3,162,304 discloses a system for packaging a composition, which system has a support that co-operates with a magnet that is housed in a casing, the system using a rod that passes through perforations in the casing so as to push on the bottom of the support and move it away from the magnet. The system is also relatively complex and does not enable the composition to be extracted easily and "gently".

The invention seeks to remedy the above-mentioned drawbacks by proposing a device that can be handled simply and reliably, given the above-described constraints.

This object is achieved by means of the fact that the device of the invention further comprises first and second magnetic elements that are secured to the support and to the casing respectively, by the fact that, when the support is in its retracted position in which said magnetic elements are in a first relative position, the elements generate magnetic forces between them, which magnetic forces are suitable for holding said support in its retracted position, by the fact that the actuator is connected to the support in such a manner that actuating the actuator causes a first movement of the support, moving the magnetic elements away from said first relative position, thereby reducing said magnetic forces in such a manner as to enable the support to move towards its extended position, and by the fact that the device further comprises thrust means that are suitable for causing the support to move towards its extended position after the first movement of the support.

Thus, with the device of the invention, the support is held in its retracted position by the magnetic forces that are generated between the magnetic elements carried by the support and by the casing respectively. Consequently, the holding means for holding the support in its retracted position do not make use of friction or snap-fastening forces. There is therefore no risk of wear by friction. In addition, in order cause the support to pass from its retracted position to its extended position, it suffices, by moving the support, to move the two magnetic elements apart from each other, so that the magnetic forces weaken and cease holding the support in its retracted position. When the user operates the actuator, thereby causing the support to move with it, the user has an impression of movement that is continuous, without it being necessary for the user to overcome a hard point, or the like, in order to make such movement possible.

When the composition is put back into place and when the support is returned into its retracted position from its extended position, the movement of the support reaches a point from which the magnetic forces become sufficiently strong to attract the support into its retracted position. Thus, even if the user does not pay attention while handling the device and moves the support towards its retracted position without pushing it all the way into its retracted position, the support reaches its retracted position on its own as a result of the magnetic forces involved. The system is thus particularly reliable. It should also be observed that the magnetic elements may be made with very small dimensions, and consequently do not affect the overall size of the device. By way of example, the two magnetic elements may be magnets. Provision may also be made for only one of the magnetic elements to be a magnet, the other element thus being a piece made out of a material that is sensitive to the magnetic field generated by the magnet, e.g. a material containing iron. Each of the magnetic elements may be constituted by a single piece, or by a plurality of small pieces that are arranged in such a manner as to promote a uniform distribution of forces and of masses.

In addition, the thrust means also make it easier to handle the device for passing the support from its retracted position to its extended position. Specifically, once the magnetic forces are reduced sufficiently, the thrust means overcome them and bring the support into its extended position themselves. Thus, once the first movement has been made, the support continues to move automatically. The composition can thus be extracted automatically and gently. Advantageously, after its first movement, the support is capable of moving towards its extended position without causing the actuator to move.

Thus, although the user's fingers are still in contact with the actuator, said actuator remains in the position that it reached in order to enable the expected reduction in magnetic forces, and the support can thus move towards its extended position without the user having to release the actuator, or to slide it with the support.

Advantageously, the support is moved between its retracted position and its extended position essentially or solely by sliding in translation.

Advantageously, the actuator is connected to the support via a movable slider, being guided by a track to move along a stroke that enables the support to pass from its retracted position to its extended position.

This slider and track arrangement enables the support and the actuator to be constrained together in rotation in effective manner, using means that are simple and inexpensive.

In this configuration, at least one of the edges of the track that co-operates with the slider advantageously presents a flexible strip.

The flexible strip makes it possible to brake the movement of the support, or, at the least, to avoid it moving too fast, at least at the start of the movement.

Advantageously, the thrust means comprise a spring. It is also advantageous for the spring to be arranged between the support and the bottom end wall of the casing, which bottom end wall is remote from the open end of said casing.

The spring may be a helical spring that is simple to manufacture and inexpensive.

Advantageously, the device includes return means for returning the actuator towards its initial position after actuation.

These means may take the form of return means of the spring type, e.g. a helical spring or a leaf spring.

According to an advantageous possibility, the first and second magnetic elements face each other angularly in the retracted position of the support.

For example, in the retracted position, the first and second magnetic elements are situated one above the other in the movement direction of the support. Acting on the actuator may have the effect of offsetting them angularly, thereby reducing the magnetic forces generated between them. In this event, the actuator is turned. Provision may alternatively be made for the actuator to be moved in translation, parallel to the movement direction of the support, such that acting on the actuator has the effect of moving the first and second magnetic elements apart from each other in this direction, while the elements continue to face each other angularly.

Specifically, it is possible to opt for an actuator that is suitable for being moved in translation in the movement direction of the support, so as to cause the support to move in translation during said first movement, or for an actuator that is suitable for being turned, so as to cause the support to turn about its movement axis during said first movement.

Advantageously, the actuator co-operates with a slot formed in the wall of the casing, and presents at least one drive tab that passes through the slot and co-operates with the support.

This constitutes a simple connection between the actuator and the support, and does not affect the overall size of the device.

The invention can be well understood and its advantages appear better on reading the following detailed description of embodiments shown by way of non-limiting examples. The description refers to the accompanying drawings, in which:

FIG. 1 is a section view of the device of the invention, in a first embodiment, the section being taken parallel to the movement axis A of the support, said support being shown in its retracted position;

FIG. 2 is a section on plane II-II in FIG. 1, the line I-I on which the section in FIG. 1 is taken, being shown in FIG. 2;

FIG. 2A is view of a detail as seen looking along arrow IIA in FIG. 2;

FIG. 6 is a section view of the device in a second embodiment of the invention, taken parallel to the movement axis A of the support, said support being shown in its retracted position;

FIG. 7 is a section on plane VII-VII in FIG. 6, with the line VI-VI on which the section in FIG. 6 is taken, being shown in FIG. 7;

Figure 3:
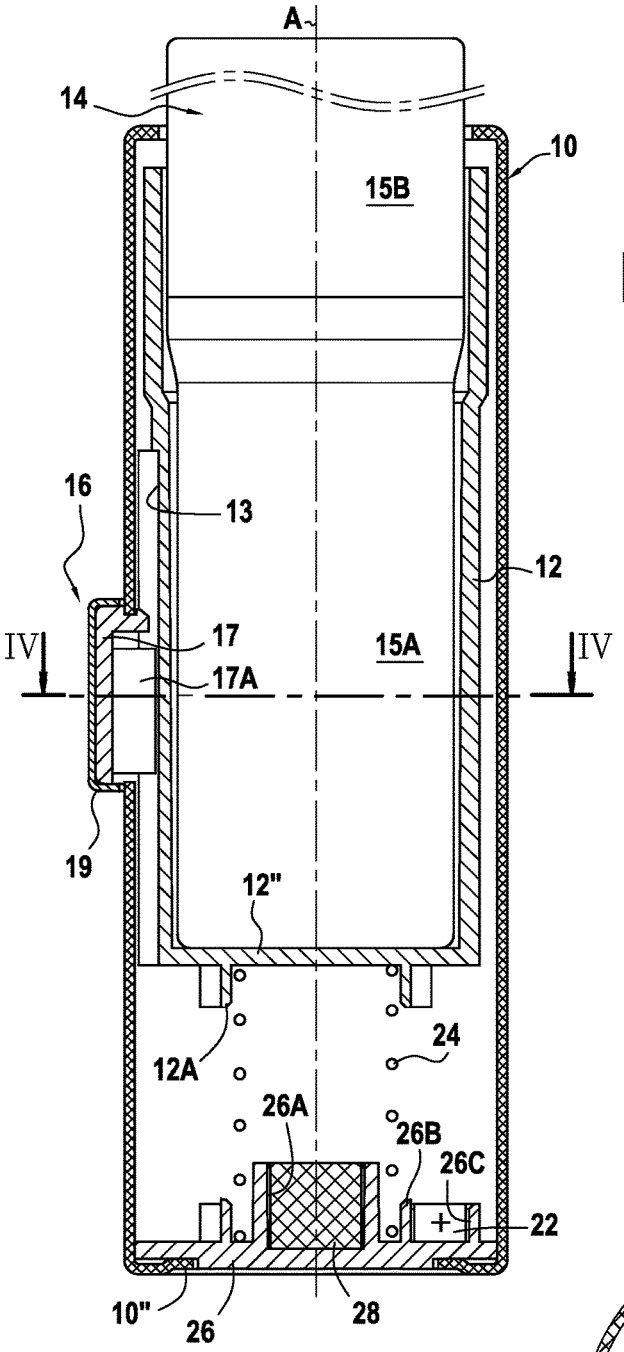
FIG. 3 is a section similar to the section in FIG. 1, after the actuator has been moved, the support reaching its extended position.

The first embodiment of the invention is described initially with reference to FIGS. 1 to 5B.

The device shown in the figures comprises a casing 10 having an open end 10' and a bottom end wall 10" that is remote from the open end. The casing is generally cylindrical in shape.

A support 12 of generally cylindrical shape is situated inside the casing 10. In FIG. 1, the support 12 is in its retracted position. Specifically, it can be seen that it is arranged towards the bottom end wall 10" of the casing so that the article 14 arranged in the support 12 is itself retracted into the casing, the top end 14A of the article 14 projecting little, or not at all, through the opening at the end 10' of the casing. Specifically, the support 12 has an open top end 12' and a closed bottom end 12" against which the bottom end 14A' of the article 14 bears.

In the meaning of the present patent application, the upward direction is in direction D along which the support slides so as to pass from its retracted position to its extended position. The terms "bottom" and "top" are used accordingly.

The device includes an actuator 16 that is suitable for being moved so as to cause the support to move, specifically to slide, from its retracted position to its extended position. In this configuration, the actuator is made up of a control piece 17 that co-operates with the support, and of a decorative cover 19 that is crimped onto the piece 17. Naturally, the actuator could be made as a single piece.

It can be seen in FIGS. 1 to 4 that the device includes a first magnetic element 20 that is secured to the support 12, and a second magnetic element 22 that is secured to the casing 10.

Figure 4:
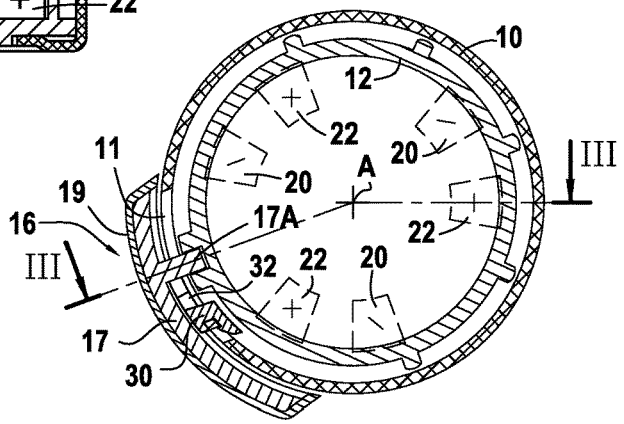
FIG. 4 is a section view on plane IV-IV in FIG. 3, the line III-III on which the section in FIG. 3 is taken, being shown in FIG. 4.

In FIG. 1, the support is in its retracted position, and it can be seen that the first and second magnetic elements 20 and 22 are facing each other. In this configuration, they are arranged one above the other in the direction of the sliding axis A of the support. Magnetic forces are thus exerted between them, which magnetic forces hold the support in its retracted position. From the section in FIG. 2, it can also be understood that, in this position, the two magnetic elements are in alignment one above the other. In this configuration, as can be seen in FIGS. 2 and 4, each of the magnetic elements is made out of a plurality of portions. Thus, the first magnetic element 22 is made up of three small magnets that are secured to a bottom portion of the casing and that are regularly distributed angularly. Similarly, the first magnetic element 20 is made up of three small magnets that are secured to the bottom end wall of the support 12 and that are regularly distributed angularly.

The actuator 16 or, more precisely, the control piece 17, carries a spline 17A that projects towards the axis A so as to form a slider. Correspondingly, the outer wall of the support 12 presents a track 13 that is formed between two splines that are parallel to the axis A, in which track the slider 17A is inserted. The spline 17A thus forms a drive tab, and it should be understood that when the actuator 16 is turned about the axis A in the direction F shown in FIG. 2, it causes the support 12 to turn with it. This movement causes the first and second magnetic elements 20 and 22 to move relative to each other, moving them apart angularly, as can be seen in FIG. 4. Under the effect of this movement, the magnetic-attraction forces between the first and second magnetic elements diminish, and the support can thus be moved from its retracted position to its extended position shown in FIG. 3.

In the embodiment shown, the device includes a spring 24 that is arranged between the bottom end wall 12" of the support 12, and the bottom end wall 10" of the casing 10. The spring 24 exerts a return force on the support 12 continuously, tending to urge it towards its extended position. While the first and second magnetic elements remain facing each other, as shown in FIG. 1, the magnetic forces generated between the elements are of amplitude that is greater than the return force exerted by the spring, such that the support remains in its retracted position. In contrast, as a result of the above-mentioned movement of the actuator 16, the amplitude of the magnetic forces exerted between the first and second magnetic elements decreases sufficiently to be exceeded by the amplitude of the return force exerted by the spring, so as to enable the support to pass automatically from its retracted position to its extended position. This is what is shown in FIG. 3.

In the embodiment shown, the bottom end wall 12" of the support 12 presents an annular rib 12A that projects below the bottom end wall. The top end of the spring 24 is blocked in the housing defined by the rib. In this configuration, the first magnetic element is arranged on the radially-outer side of the rib. As indicated above, in this configuration, it is made in the form of three magnetic-element portions, each of which is housed in a housing 12B formed below the bottom end wall 12".

The facing bottom end wall 10" of the casing 10 is formed by a piece 26 that forms a closure disk and that is fastened by any appropriate means to the cylindrical wall of the casing 10. The piece 26 presents a central housing that is defined by an upwardly-projecting annular rib 26A and that houses a ballast weight 28, enabling the device itself to tend to be positioned vertically, with its bottom end at the bottom. Around the annular rib 26A, the bottom end wall 26 presents another annular rib 26B that is in register with the rib 12A of the bottom end wall of the support 12. The bottom end of the spring 24 is thus blocked between the ribs 26A and 26B. On the radially-outer side of the rib 26B, the bottom end wall 26 presents housings 26C for the second magnetic element 22, or, more precisely, for its three portions.

It should be understood that as soon as the actuator has been actuated so as to move the first and second magnetic elements apart from each other, the spring 24 causes the support 12 to slide, thereby causing the top end 14A of the article 14 to project beyond the open end 10' of the casing 10, as can be seen in FIG. 3.

As can be seen in FIGS. 2 and 4, the outside wall of the support 12 presents spacer splines 12C that guide it in its sliding relative to the inside wall of the casing 10.

In order to enable the actuator 16 to move, the wall of the casing presents a slot 11 having a circumferential length that limits the stroke of the actuator. As can be seen in FIGS. 2, 2A, and 4, an inner fitting 30 is secured to the edge of the slot 11, which edge is parallel to the axis A, and towards which the actuator is moved so as to trigger movement of the support. The fitting carries a spring, specifically formed by a spring strip 32, that co-operates with the spline 17A of the actuator so as to urge said actuator continuously to return towards its initial position. In addition, as can be seen in FIG. 2A, the actuator presents inner clip or snap-fastener tabs 17B that are clipped on the edges of the slot perpendicularly to the axis A, so as to hold the actuator relative to the casing. In addition, the clip tabs are positioned so as to define the end of the actuator's stroke. Specifically, at the end-of-stroke position of the actuator, they come into abutment against the edges of the slot that are parallel to the axis A.

Figure 5A:
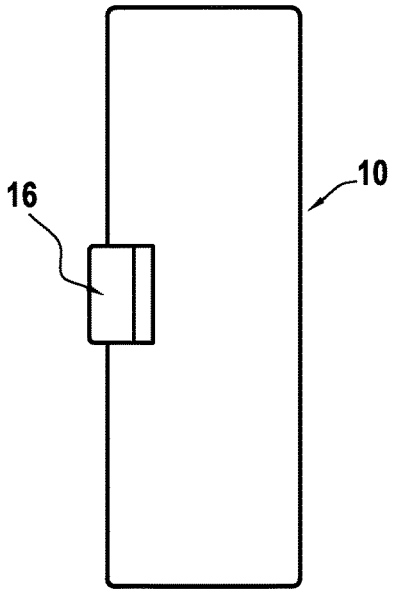
FIGS. 5A and 5B are two external views of the device in elevation, corresponding to the situation in FIG. 1 and to the situation in FIG. 3, respectively.
Figure 5B:
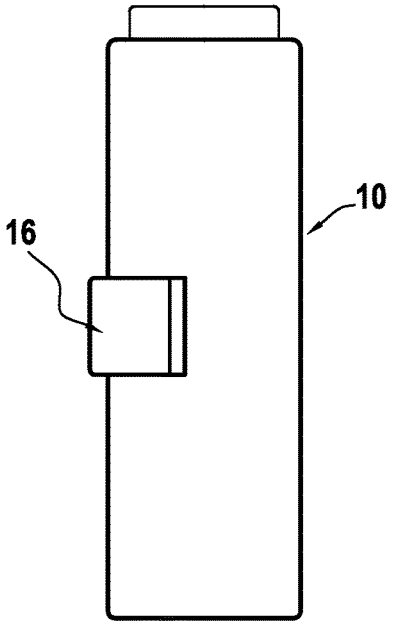

FIG. 5A shows the initial position of the actuator, while FIG. 5B shows its position after actuation, this position corresponding to the position in FIG. 4.

The second embodiment of the invention is described below with reference to FIGS. 6 to 8B.

In the second embodiment, the device comprises a casing 110 having an open end 110' that is remote from its closed end 110", and a support 112 that is suitable for moving in the casing between its retracted position and its extended position. The article 114 is arranged in the support 112. The casing and the support are of shape that is generally cylindrical. The actuator 116 arranged on the side of the casing may be moved upwards in translation along arrow F, in the same direction as the movement direction D of the support, and parallel thereto.

The first magnetic element 120 is arranged in a housing that is defined by an annular rib 112A that projects below the bottom end wall 112" of the casing 112, remote from the open end 112' of the casing. The second magnetic element 122 also forms a ballast weight for the device. A housing is provided that is defined by an annular rib 126A projecting upwards from the washer 126 forming the bottom end wall of the casing. In this configuration, the first magnetic element is a magnet, while the second magnetic element 122 is made out of a material that is sensitive to magnetic attraction, such as a ferromagnetic material. A spring 124 is arranged between the bottom end wall of the casing and the bottom end wall of the support. The bottom end of the spring is blocked by an annular rib 126B that forms a rim of the bottom end wall of the casing, situated inside said casing. The top end of the spring 124 is blocked by ribs 112B that are situated on the radially-outer side of the rib 112A of the bottom end wall of the support 112. As can be seen in FIG. 6, the two magnetic elements 120 and 122 are centered on the axis A of the device.

As can be seen in FIG. 7, the actuator 116 presents two drive tabs 117A and 117B that pass through slots 111A and 111B respectively of the wall of the casing 110, so as to come into engagement in the slots 113A, 113B presented by the wall of the support 112. The inner ends of the tabs 117A and 117B are hook shaped, such that the tabs co-operate with the edges of the slots 113A and 113B by clipping or snap-fastening. Although the slots 113A and 113B are of a height, measured parallel to the axis A, that corresponds to the height of the tabs 117A and 117B, it should be understood that, in contrast, the slots 111A and 111B are of height that is greater. Thus, the actuator 116 may be moved upwards along arrow F shown in FIG. 6 so as to cause the support 112 to move with it. The upward movement of the actuator is limited by the top edges of the slots 111A and 111B. For better understanding, the tabs 117A and 117B and the slots 111A and 111B are shown diagrammatically in FIG. 8B.

Figure 8A:
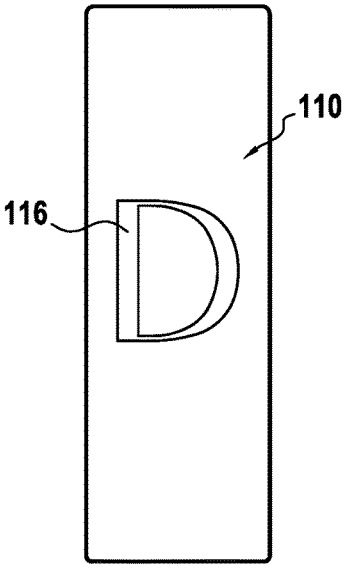
FIGS. 8A and 8B are two elevation views of the device seen from the outside, in the situation in FIG. 6 and after movement of the actuator, respectively.
Figure 8B:
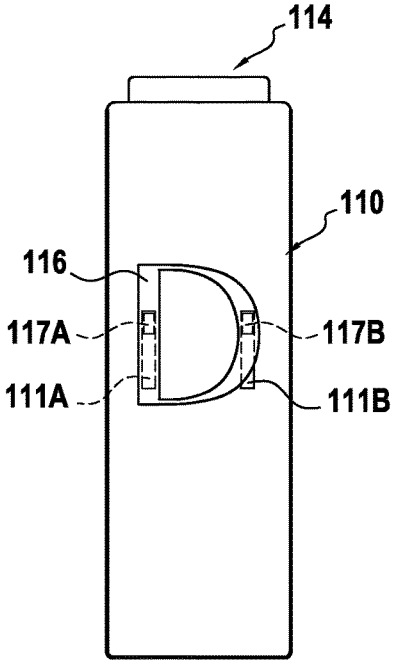

It should be understood that, at the end of the actuator's stroke, in the position shown in FIG. 8B, the first magnetic element 120 has moved far enough away from the second magnetic element 122 for the amplitude of magnetic-attraction forces between the two elements to have diminished sufficiently for it to be overcome by the upward return force exerted by the spring 124. The article 114 may thus be projected naturally towards its position in which its top end projects beyond the top end of the casing 110, as shown in Figure B.

In this embodiment, the actuator is moved in translation in the sliding direction of the support so as to cause the support to move with it, and the two magnetic elements continue to face each other angularly.

In the first and second embodiments, the shape of the actuator can be chosen freely. Thus, in the example shown for the second embodiment, it has been given a shape that contributes to the appearance of the packaging, e.g. the shape of the letter D. The actuator may be made as a single piece, or it may present a decorative cover plate, as in the first embodiment.

The third embodiment of the invention is described below with reference to FIGS. 9 to 14.

Figure 9:
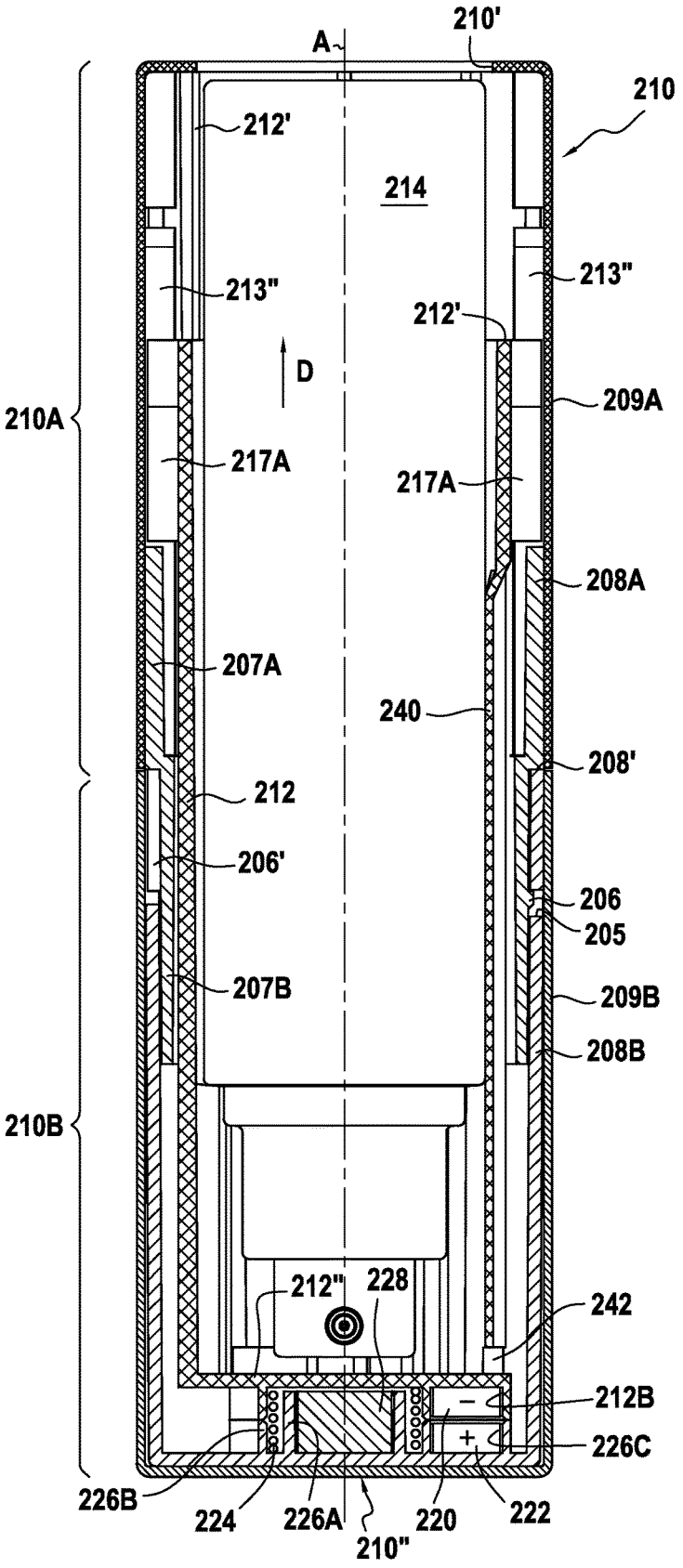
FIG. 9 is a section view of the device of the invention, taken parallel to the movement axis A of the support, said support being shown in its retracted position.
Figure 12:
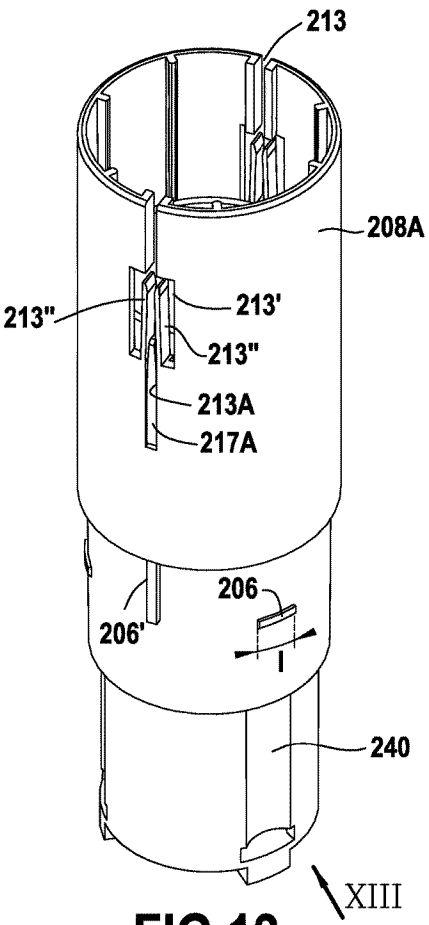
FIG. 12 is a perspective view similar to the view in FIG. 10, this time with the base portion of the casing omitted.

In FIG. 9, it can be seen that the device comprises a casing 210, with an open top end 210', and a closed bottom end 210". In this configuration, the actuator is formed by a portion of the casing. Specifically, said casing presents a rotary portion 210A and a base portion 210B. In addition, for reasons of appearance, the casing includes an outer sheath made up of two portions, 209A and 209B respectively. Arranged inside the sheath, the casing also includes a rotary portion 208A that is arranged inside the rotary portion 209A of the sheath, and a base portion 208B that is arranged inside the base portion 209B of the sheath. Thus, firstly the portions 208A and 209A, and secondly the portions 208B and 209B, form the sheath portions 210A and 201B.

In order to pass from its retracted position to its extended position, the support 212 for the composition is suitable for sliding in the casing in the direction D parallel to the axis A of the device.

Figure 13:
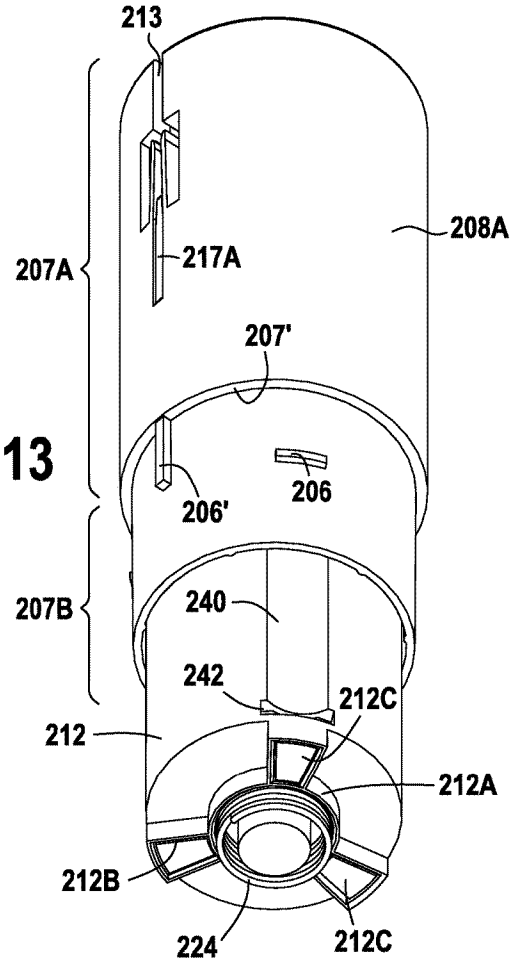
FIG. 13 is perspective view as seen looking along arrow XIII in FIG. 12.

The first magnetic element 220 is secured to the support 212, while the second magnetic element 222 is secured to the casing, and more precisely to the base portion 208B. In this configuration, as in the embodiment in FIGS. 1 to 5B, each magnetic element is made out of a plurality of portions that are regularly distributed angularly. Thus, as can be seen in FIG. 13, on its face facing towards the bottom end wall 210" of the casing, the bottom end wall of the support 212 includes three housings 212B for the three portions that constitute the first magnetic element 220. The housings are formed by cavities defined by ribs that are radially outside an annular rib 212A. The top end of a return spring 224 is housed in the housing defined by the annular rib 212A. The facing bottom end wall 226 of the base portion 208B of the casing presents an annular rib 226A that defines a housing in which a ballast weight 228 is housed. The rib 226A is surrounded by an annular rib 226B against the inside face of which the bottom end of the spring 224 is arranged. The housings 226C for the three portions that form the second magnetic element 222 are arranged radially outside the rib 226B.

As can be seen in FIG. 9, in the retracted state of the support 212, the first and second magnetic elements are arranged facing each other angularly. In order to enable the support to pass into its extended position, the rotary portion 210A of the casing is turned in such a manner as to offset the first magnetic elements angularly relative to the second magnetic elements, thereby reducing the attraction force between the elements, and enabling the support to be ejected under the effect of the force exerted by the spring 224. Thus, the top portion of the sheath 209A and the rotary top portion 208A that are secured to each other, form an actuator that, by being turned, enables the support to pass from its retracted position to its extended position.

Figure 10:
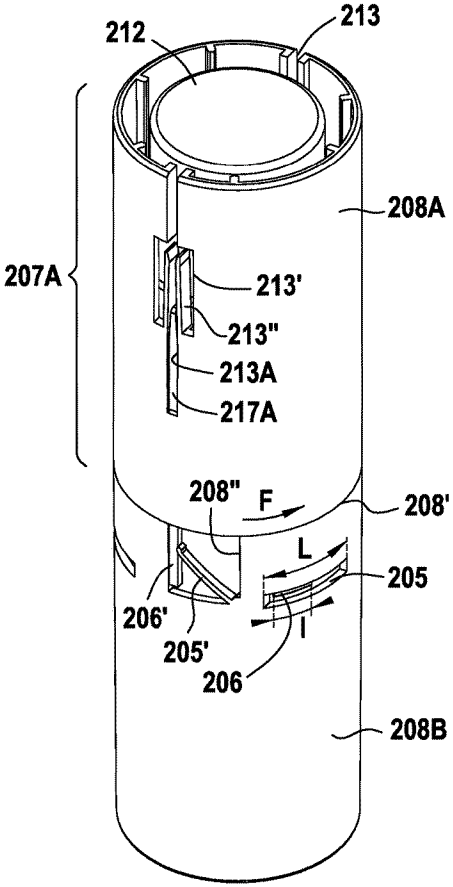
FIG. 10 is a perspective view of the FIG. 9 device, with the outer sheath of the casing omitted, and with the support in its retracted position.

The rotary portion 208A comprises a top portion 207A that, as can be understood in particular in FIG. 10, extends upwards beyond the base portion 208B, and a bottom portion 207B that is engaged in the open top end of the base portion 208B (see FIG. 9). In this configuration, the bottom portion 207B has a diameter smaller than the top portion 207A, and the two portions are interconnected via a shoulder 207' (see FIG. 13) that bears against the top edge 208' of the base portion 208B when the rotary portion 208A and the base portion 208B are assembled together. The bottom portion 207B of smaller diameter presents transverse ribs 206 that are engaged in transverse slots 205 of the base portion 208B, as can be seen in FIG. 10. The base portion 208B and the rotary portion 208A are secured to each other. Thus, the base portion 208B and the rotary portion 208A are advantageously held together by snap-fastening or clipping, so as to ensure that the top portion 208A cannot be pulled off the base portion 208B. As can be seen in the figures, the peripheral length L of the slots 205 is greater than the peripheral length l of the ribs 206. Thus, the ribs 206 move in the slots 205 while the top portion of the casing is turning.

Advantageously, one of the parts formed by the base portion and by the rotary portion presents a rib that co-operates with a return tab that is secured to the other one of said parts.

In this configuration, the rotary portion 208A presents a longitudinal spline 206' that is arranged in a notch 208" in the top edge of the base portion 208B. More precisely, the spline 206' is formed projecting from the above-mentioned smaller-diameter portion 207B. It can be seen in particular in FIG. 10 that the base portion 208B presents a flexible return tab 205' that is secured to one of the edges of the notch 208". The free edge of the tab 205' bears against the spline 206'. It should thus be understood that after the rotary portion 208A has been turned in the direction of arrow F shown in FIG. 10, co-operation between the tab 205' and the spline 206' tends to return the rotary portion 208A, and thus the actuator, into its initial position.

As in the first embodiment, the actuator is connected to the support via a slider that is suitable for sliding in a track that is parallel to the sliding direction D of the support (it being possible to invert the configuration, i.e. the slider could slide on the track or along said track). In this configuration, as can be seen better in FIG. 11, the support 212 presents a longitudinal spline 217A that is arranged in a track-forming slot 213 of the rotary portion 208A. Specifically, and as can be better understood on considering FIGS. 10 and 12, the rotary portion 208A presents two identical diametrally-opposite slots 213, and likewise the support 212 presents two diametrally-opposite splines 217.

Figure 11:
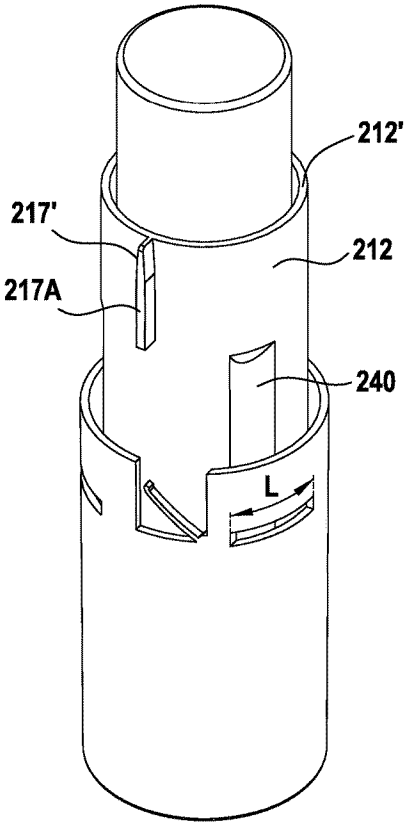
FIG. 11 is a perspective view similar to the view in FIG. 10, with the rotary portion of the casing omitted.

As mentioned at the beginning of the present patent application, at least one of the edges of the track that co-operates with the slider advantageously presents a flexible strip. In this configuration, a central portion of the slot 213 presents a widening 213' in which two flexible strips 213" are provided, between which there is formed a passage for the spline 217A. The top ends of the flexible strips 213" are free, and the strips naturally move closer together towards their top ends. In FIG. 11 in particular, it should be observed that the top end 217' of the spline 217A is beveled in such a manner as to encourage it to co-operate with the flexible strips 213". Specifically, it should be understood that when the support moves upwards inside the casing, the spline 217A tends to move the flexible strips 213" apart from each other. The flexible strips thus tend to brake the upward movement of the support. This makes it possible to avoid moving the support too suddenly at the start of its movement stroke, even though the spring 224 is pushing it upwards.

In this configuration, the spline 217A is situated towards the top of the support 212, and its top end coincides with the top edge 212' of the support.

It should be understood that when the rotary portion 208A is turned in the direction of arrow F shown in FIG. 10, the rotary portion causes the support to turn, the spline 217A then being in the bottom portion 213A of the slot 213 that does not have flexible strips, and this causes the first magnetic element to move away from the second magnetic element. Once the return force exerted by the spring 224 has overcome the magnetic-attraction force as weakened in this way, the spring 224 pushes the support upwards. The spline 217A thus moves in the slot 213 as shown.

Once the user relaxes grip on the rotary top portion of the casing, said rotary top portion returns into its initial position under the effect of the return force exerted by the strip 205' on the spline 206'.

Figure 14:
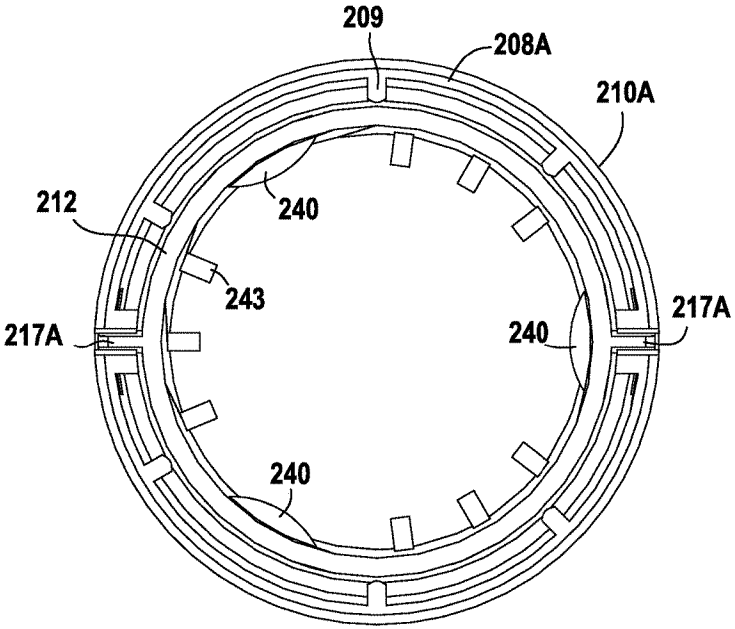
FIG. 14 is a plan view of the device shown in FIG. 10.

The article 214 is arranged in the support 212. In the embodiment shown in FIG. 9, the article is in the form of a mini-spray that is arranged head down in the support. The article 214 is quite simply held by elastic friction inside the support 12. To this end, the support presents beads 240 that form internal longitudinal bulges on its inner periphery. The beads also correspond to portions in which the wall of the support 12 is thin. In order to enhance the springiness of the beads, transverse slots 242 are formed between the bottom ends of the beads and the base of the support. By way of example, there are three beads are and they are regularly distributed angularly, as can be seen in FIG. 14.

The inner periphery of the rotary portion 208A presents a plurality of radial ribs 209 that serve as spacer ribs for the support 212.

In addition, in the embodiment shown, in order to block the head of the spray in order to avoid accidentally triggering it when it is put into place in the support, the bottom of the support presents radial splines 243.

In the embodiments described above, the first and second magnetic elements are made out of three portions (first and third embodiments) or out of one portion (second embodiment). Naturally, they could be made out of some other number, it being advantageous however for the movement axis A of the support to correspond to their axis of symmetry, so as to balance the masses of the device.

In general, the packaging device serves to house an article. Said article is shown in extremely diagrammatic manner in the drawings. As mentioned above, in FIG. 9, the article 214 is in the form of a mini-spray. In FIGS. 1 and 6, only the substantially-cylindrical body of the article is shown. The body may be a lipstick holder having, as shown in the figures, two sections of diameters that are different, namely a smaller-diameter section 15A or 115A that is arranged towards the bottom end wall of the support, and a larger-diameter section 15B or 115B that is arranged towards the top portion of the support. By way of example, for a lipstick holder or the like, the portion 15B or 115B may turn relative to the portion 15A or 115A so as to cause the stick to extend via the open free end 14A' or 114A' of the portion 15A or 115A.

The invention claimed is:

1. A packaging device for packaging a composition, the device comprising:

a casing having an open end;

a composition support that supports the composition, the composition support is movable in the casing between a retracted position and an extended position that provides access to the composition via said open end;

an actuator that is suitable for being moved so as to cause the composition support to move from its retracted position to its extended position;

first and second magnetic elements that are secured to the composition support and to the casing respectively; wherein the second magnetic element is stationary with respect to the casing when the composition support is moved between the retracted position and the extended position; wherein, when the composition support is in the retracted position thereof in which said first and second magnetic elements are in a first position one with respect to the other, the first and second magnetic elements generate magnetic forces between them, which magnetic forces are suitable for holding said composition support in said retracted position; wherein the actuator is connected to the composition support in such a manner that actuating the actuator causes a first movement of the composition support, moving one of the first and second magnetic elements away from the other one of the first and second magnetic elements so that the first and second magnetic elements cease to be in the first position one with respect to the other, thereby reducing said magnetic forces in such a manner as to enable the composition support to move towards its extended position; and a spring that applies a force to the composition support to cause the composition support to move towards its extended position after the first movement of the composition support.

2. A device according to claim 1, wherein the spring causes the composition support to move towards its extended position after the first movement without further displacement of the actuator.

3. A device according to claim 1, wherein the spring is arranged between the composition support and a bottom end wall of the casing, the bottom end wall is remote from the open end of said casing.

4. A device according to claim 1, wherein the actuator is configured to be returned towards its initial position after actuation.

5. A device according to claim 1, wherein, in the first position of the first and second magnetic elements said first and second magnetic elements face each other in the retracted position of the composition support.

6. A device according to claim 1, wherein the actuator is configured to be moved in translation in a sliding direction of the composition support, so as to cause the composition support to move in translation during said first movement.

7. A device according to claim 1, wherein the actuator is configured to be turned, so as to cause the composition support to turn about a sliding axis during said first movement.

8. A device according to claim 7, wherein the actuator is connected to the composition support via a movable slider that is guided by a track to move along a stroke that enables the composition support to pass from the retracted position to the extended position.

9. A device according to claim 8, wherein the track includes edges, and at least one of the edges of the track co-operates with the slider and presents a flexible strip.

10. A device according to claim 7, wherein the actuator is a portion of the casing.

11. A device according to claim 10, wherein the casing includes a base portion in which there is housed the second magnetic element and a rotary portion that forms the actuator.

12. A device according to claim 11, wherein the base portion and the rotary portion are held together by snap-fastening.

13. A device according to claim 11, wherein one of the base portion and the rotary portion presents a spline that co-operates with a return tab that is secured to the other one of the base portion and the rotary portion.

14. A device according to claim 1, wherein the actuator co-operates with a slot formed in a wall of the casing, and the actuator includes at least one drive tab that passes through the slot and co-operates with the composition support.

15. A device according claim 1, wherein one of the first and second magnetic elements is a magnet, the other of said first and second magnetic elements being one of a magnet and a piece made out of a material that is sensitive to the magnetic field generated by the magnet.

16. A device according to claim 1, wherein the composition comprises a cosmetic article having a body that contains a cosmetic composition, and the cosmetic article is received by the composition support in a removable manner.

* * * * *